United States Patent [19]

Lingl, Jr.

[11] Patent Number: 4,616,995

[45] Date of Patent: Oct. 14, 1986

[54] TUNNEL DRYER FOR BRICKS AND LIKE OBJECTS

[75] Inventor: Hans Lingl, Jr., Neu-Ulm, Fed. Rep. of Germany

[73] Assignee: Lingl Corporation, Paris, Tenn.

[21] Appl. No.: 749,755

[22] Filed: Jun. 28, 1985

[30] Foreign Application Priority Data

Jul. 11, 1984 [DE] Fed. Rep. of Germany ..... 3425523

[51] Int. Cl.[4] ..... F27D 3/00; F27B 9/26; F27B 7/00

[52] U.S. Cl. ..... 432/9; 432/137; 432/144; 432/148; 432/194

[58] Field of Search ..... 432/137, 144, 148, 194, 432/237, 138, 9

[56] References Cited

U.S. PATENT DOCUMENTS 1,140,719 5/1915 Shaw ..... 432/137
1,778,747 10/1930 Barnebey et al. ..... 432/137
3,388,439 6/1968 Tomkins ..... 432/137
3,618,919 11/1971 Beck ..... 432/237
4,406,618 9/1983 Maeyama ..... 432/138

FOREIGN PATENT DOCUMENTS 601004 8/1934 Fed. Rep. of Germany ..... 432/137

*Primary Examiner*—John J. Camby
*Attorney, Agent, or Firm*—Nixon & Vanderhye

[57] ABSTRACT

A tunnel dryer and method for drying unfired bricks or similar objects in which the tunnel comprises exhaust means for exhausting heated gases within the tunnel, partition means disposed in the drying space of the tunnel consisting of at least one vertically adjustable partition positioned upstream of the exhaust means, and means for positioning the vertically adjustable partition at an intermediate level within the drying space of the tunnel to define an effective drying zone for the unfired bricks.

10 Claims, 2 Drawing Figures

TUNNEL DRYER FOR BRICKS AND LIKE OBJECTS

FIELD OF THE INVENTION

The present invention relates to tunnel dryers for bricks and similar unfired objects and, more particularly, to a tunnel dryer for "green" bricks having exhaust means disposed at least at one end of the tunnel drying space.

BACKGROUND AND SUMMARY OF THE INVENTION

It is well known that "green" or unfired bricks and similar objects require a drying treatment in the course of their production and that the drying conditions will vary depending on the type of brick or object involved. For example, extruded bricks are often stacked prior to firing on tunnel kiln cars directly after being formed. The cars are then pushed through a tunnel dryer which has been provided with exhaust means in the tunnel drying space, generally at the entrance end, i.e., directly adjacent to the opening through which the tunnel kiln cars enter the tunnel.

Heretofore, drying tunnels have incorporated exhaust means whereby the exhaust air is drawn off through exhaust openings disposed in the roof area of the drying space without any additional exhaust means or means for controlling the air flow. Such arrangements often produce uneven drying of the bricks due to the increased flow of air along the roof (due in part to non-uniform air temperatures within the tunnel), resulting in longer drying times and, in the worst cases, damage to the bricks or ware being dried.

The present invention substantially eliminates the uneven drying problems encountered in prior art systems by utilizing a tunnel drying design having exhaust means and means for controlling the air flow within the tunnel which result in improved uniformity and efficiency of the drying process.

The particular advantages achieved by the present invention include the following. In an exemplary tunnel dryer according to the invention, the air flow along the roof of the tunnel is modified and is controlled by exhaust means which result in a more uniform and efficient drying operation. The control of the air flow is accomplished by means of one or more adjustable partitions disposed within the tunnel at preselected locations which limit and direct the cross-sectional flow of air in the region where the ware is undergoing drying. As such, the present invention prevents unwanted air flow along the roof and redistributes the air stream within the tunnel. In particular, the adjustable partition according to the invention modifies the air circulation to prevent an increased flow of higher temperature air along the tunnel roof. It is also possible to modify the air flow rate to suit various drying requirements and thereby substantially reduce the time required for the drying process since all cars, including the very first car entering the tunnel, can be subjected to a constant stream of dry air which is more uniform in temperature and flow rate. The adjustable partition in accordance with the invention may also be raised or lowered during the drying operation or after the drying is completed in order to provide the necessary cross-sectional area for loading and unloading the dryer. The partition can also be adapted to different loading heights for the cars carrying the ware to be dried, depending on the specific type and amount of materials involved.

The preferred embodiment of the present invention utilizes one or more single-piece partitions which may be vertically adjusted to extend through one or more recesses in the roof of the tunnel dryer. Specifically, means are provided whereby a partition (or partitions) can be adjusted to any vertical height within the tunnel. At its highest point of adjustment, the bottom edge of a partition will be positioned at the top of the roof line. In such a position, the partition will release the full cross-sectional area of air flow into the tunnel. In the preferred embodiment, seals may be provided between the recess and the partition to prevent the ingress of "secondary air" into the tunnel. No seals are required, however, if a housing is disposed on the roof to provide a tight seal around the recessed area. The height of such a housing must be such that it will accommodate any desired portion of the adjustable partition. If, for example, a partition is used to release substantially the full height of the air flow within the tunnel, the height of the housing must be substantially equal to the height of the partition itself.

As those skilled in the art will appreciate, various possibilities exist for the disposition of the exhaust system and adjustable partitions within the tunnel. For example, a single ventilation or exhaust system may be placed in the middle of the tunnel. In that case, two partitions in accordance with the invention would be required, with each partition disposed on either side of the ventilation or exhaust means.

Thus, it is an object of the present invention to provide for a tunnel dryer which will improve the efficiency and uniformity of the drying process.

It is a further object of the present invention to provide means for controlling the air flow within a tunnel dryer to make the air more uniform in temperature and flow rate.

It is still a further object of the present invention to provide a tunnel dryer which will reduce the drying time and reduce the possibility of damaged or non-uniformly dried ware. These and other objects of the present invention will be made more clear from the following description taken in conjunction with the appended drawings.

DETAILED DESCRIPTION OF THE DRAWINGS

Figure 1:
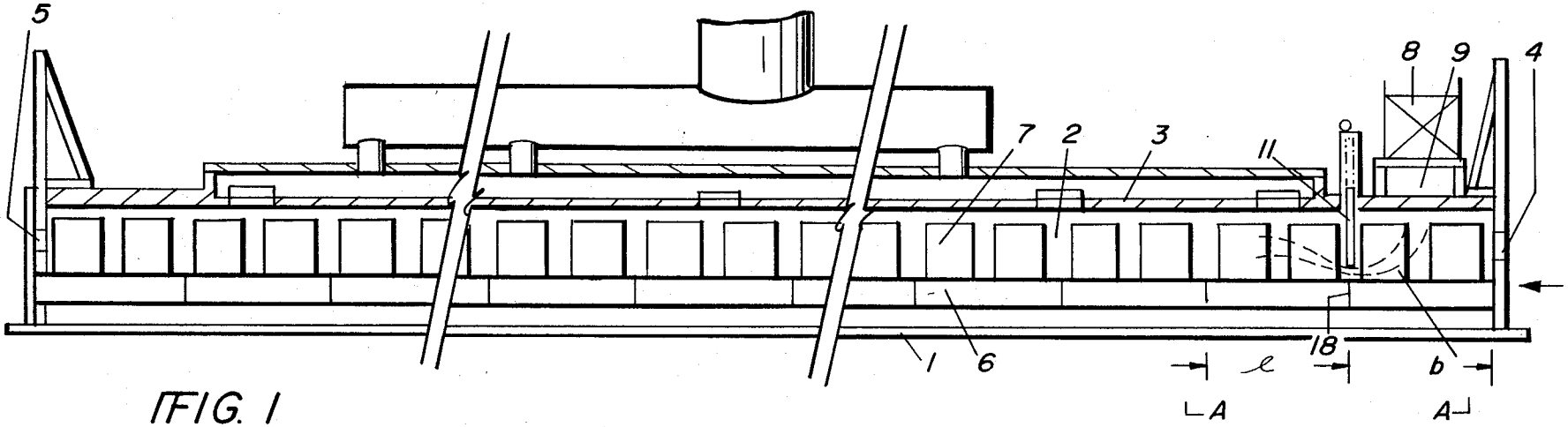
FIG. 1 shows a vertical longitudinal section of a tunnel dryer in accordance with the present invention.

With specific reference to FIG. 1, a tunnel dryer in accordance with the present invention is generally depicted at 1 and consists of a tunnel 2 having side walls (not identified by numbers) and a roof 3. The ends of the tunnel 2 can be closed by means of entrance gate 4 and exit gate 5.

Tunnel 2 is shown with cars 6 in rough outline form, each carrying ware 7 consisting of "green", i.e., unfired bricks. Directly behind the tunnel entrance gate, exhaust system 8 having exhaust opening 9 installed in roof 3. Behind exhaust system 8, a vertically extended adjustable partition 11 is installed as shown and can be adjusted to any height within tunnel 2. As such, partition 11 is capable of closing off substantially the entire cross-sectional air flow within the tunnel above the slide's lower edge (shown as 12 on FIG. 2). Partition 11 extends substantially from one side wall of tunnel 2 to the other and can be adjusted such that its lower edge is alligned with roof 3 at its uppermost position. Partition 11 is also positioned upstream of exhaust means 8 relative to the direction of air flow in tunnel 2.

Figure 2:
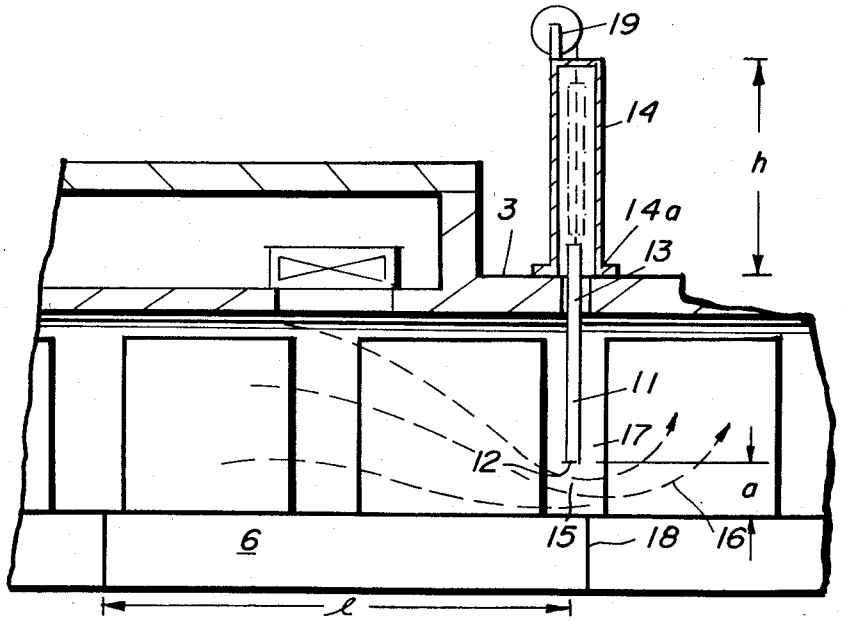
FIG. 2 shows a portion of the view depicted as "A—A" on FIG. 1 on a larger scale.

FIG. 2 shows an enlarged view of the portion of FIG. 1 identified as "A—A". The adjustable vertical partition 11 is shown in one of several possible working positions. The lower edge 12 of partition 11 is shown at a comparatively small distance "a" from the top of cars 6. The cross-sectional area of flow limited by partition 11 (shown generally as 15) includes an area of flow 16 above the cars which is drawn into the tunnel by the tunnel exhaust system. The partition is preferrably disposed in the intermediate space 17 between two stacks of bricks and a particularly advantageous arrangement is one whereby the partition is disposed in tunnel 2 at a distance "b" (see FIG. 1) from entrance gate 4 corresponding to one or more car lengths "1". In this arrangement, partition 11 is located above the interface 18 between two successive cars. As a result, the partition is always disposed in the intermediate space 17 between two successive car loads.

In order to permit the tunnel cross-section to be released to its full height, roof 3 is provided with a recess or slot 13 through which partition 11 can be moved in and out of tunnel 2. On the outside of roof 3, housing 14 is fixedly secured to roof 3 and disposed such that its lower end is open into the tunnel. Thus, housing 14 will seal off recess 13 at its lower edge as shown at 14*a*. Height "h" of housing 14 is selected such that partition 11 can be retracted into housing 14 to any desired length depending on the desired cross-sectional flow area and corresponding height of the partition itself. Once in position, partition 11 divides the drying space within the tunnel such that the effective drying zone is below the partition's lower edge.

The raised position of partition 11 is shown by dashed-dot lines in both FIGS. 1 and 2. Thus, in its fully raised position, the partition will release substantially the full height of the tunnel cross-section so that cars 6 loaded with ware 7 can be moved in and out of the tunnel without obstruction. A conventional drive mechanism for partition 11 is shown as 19.

In the preferred embodiment of the invention, partition 11 consists of a substantially flat plate which may be constructed as a single piece. As those skilled in the art will appreciate, however, other acceptable designs exist for the partition, such as a roller shutter, and all such designs are considered within the scope of the present invention. It has also been found that a plurality of adjustable partitions may be distributed along the entire length of the tunnel, thereby counteracting the flow of air along the roof in the central area of the tunnel. Such flows may occur, for example, if a larger clearance exists between ware 7 and roof 3. On the other hand, if only one partition is used, it is preferably located adjacent to the exhaust system 8 or at a distance corresponding to one car length "l" from entrance gate 4.

What is claimed is:

1. A tunnel dryer for drying unfired bricks or similar objects comprising a tunnel, exhaust means for exhausting air within said tunnel, partition means disposed in the drying space of said tunnel where said unfired bricks or similar objects are to be located, said partition means comprising at least one vertically adjustable partition disposed upstream of said exhaust means in the direction of air flow in said tunnel, and means for positioning said vertically adjustable partition at an intermediate level within the drying space of said tunnel to define an effective drying zone for said unfired bricks below the lower edge of said adjustable portion.

2. A tunnel dryer as recited in claim 1, wherein said exhaust means is disposed at one end of said tunnel in the direction of air flow in said tunnel.

3. A tunnel dryer as recited in claim 1, wherein said exhaust means is disposed substantially at the center of said tunnel and one or more vertically adjustable partitions is disposed on each side of said exhaust means.

4. A tunnel dryer as recited in claim 1, wherein said vertically adjustable partition comprises a substantially flat plate having height and width dimensions substantially equal to the height and width of said tunnel.

5. A tunnel dryer as recited in claim 1, wherein a portion of the roof of said tunnel is vertically recessed to extend through the top of said roof and is sized such that said vertically adjustable partition may be moved vertically within said recessed portion of said roof.

6. A tunnel dryer as recited in claim 2, wherein said recessed portion of said roof is surrounded by a housing open at its lower end and fixedly secured to the outside of said roof to provide a tight seal between said recessed portion and said roof.

7. A tunnel dryer as recited in any one of claims 1, wherein said exhaust means is disposed at the entrance of said tunnel and wherein said partition is disposed at a distance from said entrance corresponding to one or more lengths of cars carrying objects to be dried in said tunnel.

8. A dryer for drying unfired objects of the type having a tunnel defining a drying space in which the unfired objects are to be located, said dryer comprising means for providing a continuous flow of heated gases in said drying space;

means for positioning a vertically adjustable partition downwardly within said tunnel at an intermediate level in said gas flow to force said heated gases downwardly and under said vertically adjustable partition: and means for exhausting said continuous flow of heated gases from said drying space.

9. A method for drying unfired objects in a dryer of the type having a tunnel defining a drying spaced in which the unfired objects are to be located and through which heated gases flow, said method comprising the steps of:

providing a continuous flow of heated gases in said drying space;

positioning a vertically adjustable partition downwardly within said tunnel at an intermediate portion of said gas flow to force the gases downwardly and under said vertically adjustable partition; and exhausting said continuous flow of heated gases from said drying space.

10. A method according to claim 8, wherein said step of positioning said vertically adjustable partition defines an effective drying zone below the lower edge of said vertically adjustable partition.

* * * * *